United States Patent [19]

Kinsley, Jr.

[11] Patent Number: 4,557,800

[45] Date of Patent: Dec. 10, 1985

[54] PROCESS OF FORMING A POROUS CELLULOSIC PAPER FROM A THERMAL TREATED CELLULOSIC NON-BONDING PULP

[75] Inventor: Homan B. Kinsley, Jr., Powhatan, Va.

[73] Assignee: James River Corporation, Richmond, Va.

[21] Appl. No.: 674,346

[22] Filed: Nov. 20, 1984

Related U.S. Application Data

[63] Continuation of Ser. No. 385,093, Jun. 4, 1982, abandoned, which is a continuation of Ser. No. 204,173, Nov. 5, 1980, abandoned.

[51] Int. Cl.[4] ..... D21C 1/02; D21C 9/00

[52] U.S. Cl. ..... 162/20; 162/63; 162/68; 162/100

[58] Field of Search ..... 162/63, 68, DIG. 5, 162/4, 22, 23, 24, 100, 20; 260/124 R; 34/37; 241/28

[56] References Cited

U.S. PATENT DOCUMENTS

| | | | |
|---|---|---|---|
| 3,479,248 | 11/1969 | Nobile | 162/16 |
| 3,497,418 | 2/1970 | Thale et al. | 162/100 |
| 4,081,316 | 3/1978 | Aberg | 162/4 |
| 4,111,744 | 9/1978 | Reiniger | 162/100 |
| 4,162,768 | 7/1979 | Froats | 162/4 |
| 4,204,906 | 5/1969 | Liu | 162/4 |

FOREIGN PATENT DOCUMENTS

| | | | |
|---|---|---|---|
| 2000822 | 1/1979 | United Kingdom | 162/21 |

*Primary Examiner*—Steve Alvo

*Attorney, Agent, or Firm*—Burns, Doane, Swecker & Mathis

[57] ABSTRACT

A non-bonding pulp is obtained by contacting a cellulosic pulp with a non-oxidizing gaseous medium at a temperature of at least 400° F. for a period of time greater than 3 seconds or more. When a cellulose pulp comprising at least about 10% hemicellulose, i.e., wood pulp, is treated thermally with a non-oxidizing gaseous medium, a novel non-alpha pulp is obtained. When formed into a substrate such as a 60-70 pound per 3000 square feet paper, the thermally treated pulp forms a non-bonding cellulosic substrate possessing (i) a void fraction of at least 0.85, (ii) a porosity of at least 30 cubic feet per minute per square foot, and (iii) sufficient tensile strength to withstand the tension of wind-up, e.g., at least 6 lbs/inch.

32 Claims, 1 Drawing Figure

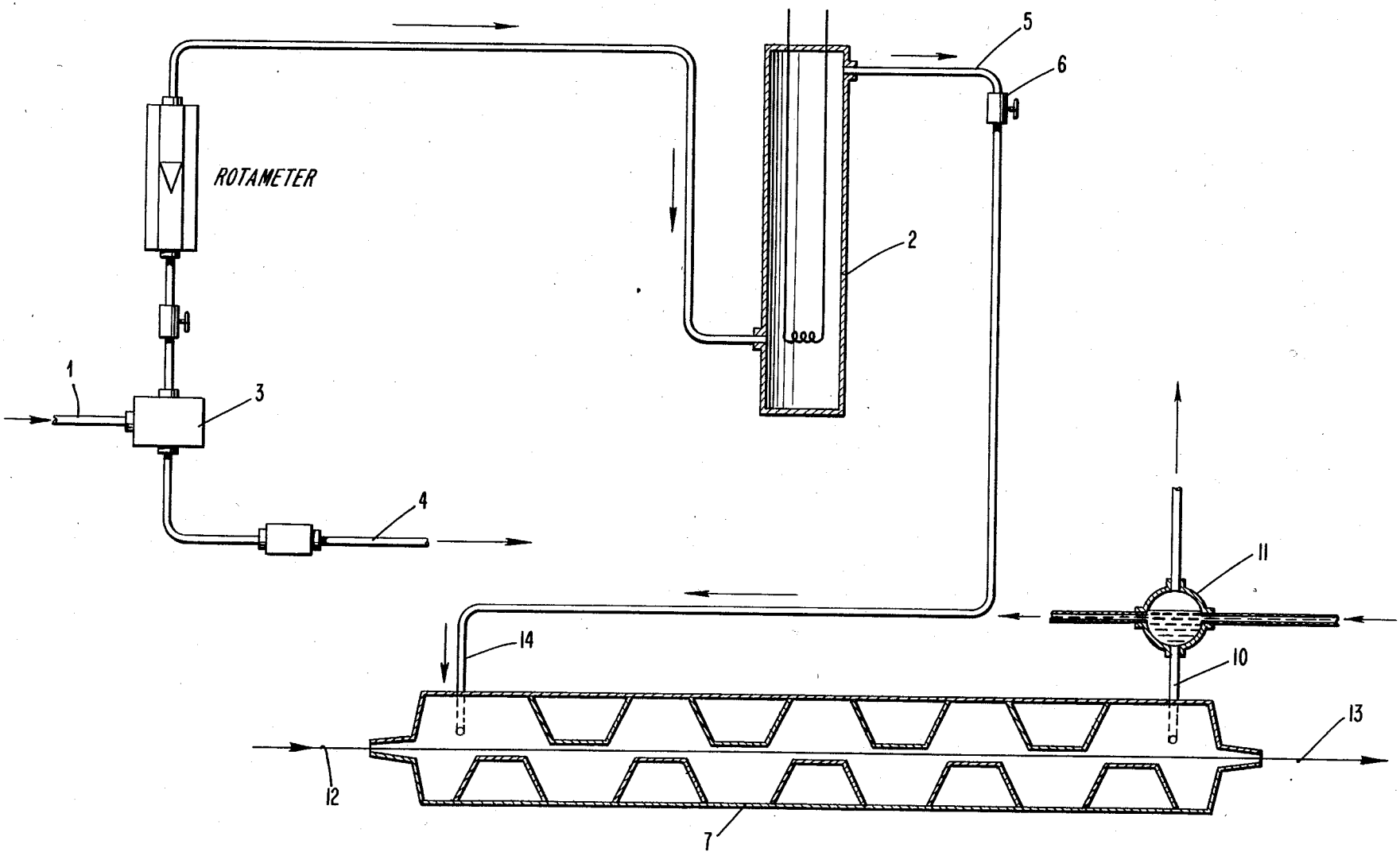
ROTAMETER
1
2
3
4
5
6
7
10
11
12
13
14

PROCESS OF FORMING A POROUS CELLULOSIC PAPER FROM A THERMAL TREATED CELLULOSIC NON-BONDING PULP

This is a continuation of application Ser. No. 385,093, filed June 4, 1982, now abandoned, which is in turn a continuation of application Ser. No. 204,173, filed Nov. 5, 1980, now abandoned.

BACKGROUND OF THE INVENTION

1. Field of the Invention

This invention relates to a process for forming a cellulosic, non-binding pulp useful in making high bulk, high porosity, fibrous cellulosic substrates which comprises contacting the pulp with a non-oxidative gaseous medium. This invention also relates to novel non-alpha cellulosic pulps and substrates made therefrom which comprise at least about 10% hemicellulose.

2. Description of the Prior Art

The treatment of cellulosic substrates, i.e., paper, with such non-oxidizing heat transfer mediums as steam is well known to the prior art. Such treatments have been employed to accomplish a number of objectives. For example, U.S. Pat. No. 2,760,410 discloses the removal of liquid water from a newly formed paper substrate by contacting therewith superheated steam. Compare U.S. Pat. Nos. 2,590,849 and 2,590,850 which make use of the latent heat of steam by employing saturated steam for the removal of water or solvents from a paper substrate. The steam employed therein is generally at relatively low temperatures, e.g., of about 150° C. (302° F.). Saturated steam has also been used to reduce the hygroscopicity of regenerated cellulose staple fibers. See U.S. Pat. Nos. 2,608,460 and 1,544,885. The treatment of cellulosic pulps, e.g., wood pulps, with a non-oxidizing gaseous medium such as steam, however, has heretofore not been known to the prior art.

Mercerization is a treatment to which cellulosic pulps such as wood pulps are frequently subjected. Chemical mercerization of a cellulosic pulp is a well known process for producing alpha pulps, i.e., pulps having an alpha cellulose content of greater than 90%. The alpha pulps obtained form high bulk and highly porous cellulose substrates which are useful as filtering media, as is well known in the art.

The economic attractiveness of the chemical mercerization process, however, which generally involves contacting a cellulosic pulp with an 18–20% caustic solution, such as sodium hydroxide, in order to dissolve the beta and gamma cellulose and leave the non-soluble alpha cellulose, is somewhat dubious due to the cost of the chemicals employed and the safeguards in the handling thereof. All of these costs add to the high cost of the final product. Moreover, there is also a loss in yield of the pulp when employing the mercerization process due to the dissolution of the beta and gamma cellulose.

Accordingly, it is an object of the present invention to provide a low-cost process for forming a cellulosic pulp suitable for making a high bulk, highly porous cellulosic substrate.

Another object of the present invention is to provide a novel cellulosic pulp containing at least about 10% hemicellulose which is suitable for forming a novel cellulosic substrate also containing at least 10% hemicellulose.

A further object of this invention is to provide a process for preparing a cellulosic pulp suitable for forming a high bulk, highly porous cellulosic substrate without experiencing a loss in yield of the pulp.

Still a further object of the present invention is to provide a process for preparing a cellulosic pulp suitable for forming a high bulk, highly porous cellulosic substrate without the use of chemicals.

Another object of the present invention is to provide a safe process for thermally treating a cellulosic pulp which requires a short residence time and avoids oxidative damage to the cellulosic fibers.

Other objects, features and the advantages of this invention will become apparent to those skilled in the art upon a study of this disclosure, the appended claims, and the drawing.

SUMMARY OF THE INVENTION

It has now been surprisingly found that upon the thermal treatment of a cellulosic pulp which comprises contacting said pulp with a non-oxidizing gaseous medium at a temperature of at least about 400° F. and for a period of time greater than three seconds, a pulp which forms a high bulk, a highly porous cellulosic substrate is obtained. When the cellulosic pulp which is treated comprises wood cellulose, or any other cellulose comprising at least about 10% hemicellulose, a novel pulp is obtained which is suitable for making a high bulk, i.e., having a void fraction of at least 0.85, highly porous, i.e., having a porosity of at least 30 cubic feet/minute/square foot, cellulosic substrate which still comprises at least 10% hemicellulose.

BRIEF DESCRIPTION OF THE DRAWING

The FIGURE of drawing is a schematic representation of apparatus suitable for carrying out the process of the instant invention.

DETAILED DESCRIPTION OF THE INVENTION

More particularly, the present invention provides one with a cellulosic pulp suitable for forming a high bulk, highly porous substrate, such as a paper, by treating the pulp in accordance with a process which comprises contacting the pulp with a non-oxidizing gaseous medium at a temperature of at least about 400° F. for a period of time greater than three seconds for fluff pulp, or for a longer period of time for less finely divided forms such as paper or thick sheets, e.g. for periods of time greater than about one minute, or more preferably about two minutes or more.

The non-oxidative gaseous medium with which the pulp is thermally treated can be any gaseous medium which will not oxidize the cellulosic fibers at temperatures above 400° F. Examples of suitable gaseous mediums are superheated steam, flue gas, carbon dioxide, nitrogen, and the inert gases helium, neon, and argon. The gases can be used alone or in combination with other non-oxidative gases.

The preferred gaseous medium, for reasons of low cost and availability, is flue gas or stack gas. The stack gas obtained upon the combustion of a fuel and air, for example, natural gas and air, will include primarily nitrogen and carbon dioxide. Such industrial sources of gaseous media are preferred due to the already heated state in which the gases are obtained which thus decreases the amount of energy necessary, if any, to heat the gases above the desired temperature, i.e., at least 400° F.

The temperature to which the cellulosic pulp fibers are subjected is such as to be sufficient to reduce the fiber hygroscopicity and thus produce a non-bonding pulp. It has generally been found that contacting a cellulosic pulp with a non-oxidative gaseous medium at a temperature of at least 400° F. is sufficient to produce a non-bonding pulp which forms a higher bulk, more highly porous cellulosic substrate than previously would have been possible from the untreated pulp. The theory, to which applicant does not wish to be absolutely bound, is that subjection of the cellulosic pulp to the high temperatures, e.g., above 400° F., results in reduced hygroscopicity of the cellulose. The decreased hygroscopicity of the cellulose fibers results in a lesser degree of bonding between the fibers so that when the treated pulp is formed into a substrate, the resulting substrate, accordingly, is more porous and bulky than otherwise possible, i.e., when the fibers had a greater tendency to bond to one another as prior to the thermal treatment.

Although any temperature of about 400° F. or above is deemed sufficient to afford the aforenoted properties to the cellulosic pulp, the preferred contacting temperature is in the range of about 400° to about 1200° F. and, more preferably, in the range of about 450° to about 900° F.

The period of time with which the cellulosic fibers are contacted with the gaseous medium depends upon the temperature employed and the physical state of the pulp. It has been found that it is generally sufficient to treat the pulp in sheet form at temperatures above about 400° F. for a period of time greater than about one minute, preferably at least two minutes, more preferably about two to six minutes, and most preferably about three to five minutes. Fluffed pulp, however requires much less time for treatment due to the greater heat transfer area. Thus, fluff pulp can be successfully treated by non-oxidative media at 400° F. or higher temperatures in a period of time greater than about three seconds.

The pressure at which the contacting of the cellulosic pulp with the gaseous medium takes place is preferably about 5 p.s.i.g. or less. Higher pressures can be employed if so desired, however, it is preferred to run the process at these low temperatures in order to simplify the apparatus employed. If higher pressures are used, a pressure vessel would have to be employed and there would be a problem of insuring the absence of gas leaks, particularly at the end seals. Thus, by employing low pressures of about 5 p.s.i.g. or less, the problems can be avoided. If desired, even a slight vacuum can be employed in the oven or contacting chamber.

The thermal treatment of the pulp can take place in any contacting chamber suitable for holding a gaseous atmosphere at the pressure employed. The chamber need only have means for introducing and removing the non-oxidative gaseous medium as well as the pulp to be thermally treated. The pulp can be treated either batchwise or as a running length. If the pulp is treated as a running length, the flow of the gaseous heat transfer medium can either be cocurrent or countercurrent to the direction of travel of the running length of cellulosic pulp.

The cellulosic pulp which can be treated in accordance with the process of the instant invention can be obtained from any suitable source. Thus, the process of the instant invention is applicable to any cellulosic pulp. For example, the cellulose can be derived from hardwoods such as aspen, post oak, or quebracho; soft woods such as the Douglas fir, hemlock, pine, spruce, red cedar or redwood; as well as other plants such as cotton. The cellulosic pulp can be mechanical pulp or chemical pulp, i.e., soda-process pulp, sulfite-process pulp, or sulfate process pulp. The instant invention can be applied to any commercial or non-commercial pulp in any form, e.g., whether it be in the form of bales, fluff, or sheets, as long as the thermal treatment is sufficient to allow contact of the gaseous medium with all of the cellulosic fibers.

It is also within the scope of the instant invention to first thermally treat in accordance therewith a formed cellulosic substrate, e.g., a paper sheet, and then repulp said sheet to obtain a cellulosic pulp capable of forming a higher bulk, higher porous substrate than that possible with a cellulosic pulp obtained from a substrate not subjected to the thermal treatment.

It is preferred, however, that the form in which the pulp is thermally treated is one of a fluffed form. By fluffed is intended a pulp which is very light, soft and airy, i.e., feather-like. This pulp condition can be obtained via conventional means, such as a hammermill, etc. If the pulp is not fluffed, it is preferred that the pulp be broken up at least to some extent in order to reduce bonding between the cellulose fibers and thus ease the slurrying of the pulp when forming into a substrate. Apparently, upon thermally treating pulp in a roll form or sheet, it is difficult to break-up and slurry the pulp subsequent to the treatment due to the reduced hygroscopicity of the cellulose fibers. This decrease in hygroscopicity renders the fibers less sensitive to water and thus less amenable to forming a slurry with water. Because a great many of the fibers of the cellulosic pulp are in a bonded state when the pulp is in a roll or sheet form, the bonds thereof will be less likely to break due to this insensitivity and thus, the bonded state of the fibers is stabilized with respect to slurrying with water.

If the pulp is in a fluffed state, however, wherein the amount of interfiber bonding has been reduced, it is easier to slurry the pulp in water after the heat treatment. Hence, it is preferred that the pulp is in a form in which the bonding between the individual cellulose fibers has been reduced, i.e., a fluffed state.

The inventive process is particularly applicable to cellulosic pulps suitable for forming paper substrates. Sulfite and sulfate (kraft) pulps derived chiefly from softwoods comprise the bulk of paper pulps and thus are the preferred pulps to which the present process has applicability.

Referring to the FIGURE of the drawing there is depicted a suitable apparatus setup for the thermal treatment of the instant invention. The non-oxidative gaseous medium to be employed is transported via conduct 1 and 5 to the contacting chamber 7. If the gaseous medium is already at the desired temperature of 400° F. or above, no additional heating is needed. However, if the gaseous medium requires additional heating, a superheater, such as an electric heater, 2, can be employed to raise the temperature of the gaseous medium. If superheated steam is the gaseous medium to be employed, a water separator 3 is preferably employed in order to separate water from the steam prior to entering the superheater 2. Any separated water can be removed via conduit 4. The removal of the water is important for insuring the efficiency of the superheater as it is more efficient to heat steam to a higher temperature than to first vaporize water and then continue to heat the steam.

A throttle valve 6 can also be employed in the conduit 5 in order to control the pressure of the gaseous medium being introduced into the contacting chamber 7. The pressure is preferably reduced to about 5 p.s.i.g. or less in order to simplify the equipment, i.e., the contacting chamber.

The contacting chamber 7 can comprise merely an insulated box with means for introducing and removing the gaseous medium and the pulp or a substrate to be contacted. In the drawing, contacting chamber 7 has a gaseous medium inlet at 14 and a gaseous outlet at 10. If the gaseous medium employed is a condensable medium such as superheated steam, the steam can be condensed upon passage through conduit 10 by employing or contacting the superheated steam with cold water introduced to conduit 10 via 11. Otherwise, the gaseous medium can be passed to further use or exhausted into the atmosphere.

The size and shape of the contacting chamber 7 is dependent upon whether the pulp or substrate to be treated is treated batchwise or as a running length. If batchwise, the chamber need only be of sufficient size to accommodate the sheets or bales of pulp to be treated. The pulp can be slid in and out of the chamber on a suitable means such as a track, or, the chamber can be provided with means for opening thereof in order to permit introduction and removal of the pulp. If the pulp is to be treated as a running length, the chamber should be long enough to allow for sufficient contact between the gaseous medium and the pulp, i.e., contact with all of the fibers of the cellulosic pulp for a period of time greater than one minute, and preferably at least two minutes. Thus, the flow rate of pulp or substrate through the chamber should be adjusted accordingly. In the case of a running length, the pulp can enter the chamber at one end, e.g., 12, and leave the chamber via the other end, e.g., 13. If a formed substrate is being thermally treated prior to repulping, the substrate can actually be unwound prior to entering the chamber and wound-up upon exit therefrom.

Some of the advantages of the instant process as compared to the prior art process of chemically mercerizing cellulosic pulp is that the instant process provides one with a relatively low-cost method for providing a pulp suitable for forming a high bulk and highly porous cellulosic substrate, i.e., a pulp which forms a substrate of more bulk and porosity than that possible prior to the thermal treatment, and, indeed, of sufficient bulk and porosity to be employed as a filtering means. The present invention also avoids the handling of caustic chemicals which are necessary for the chemical mercerization of a cellulosic pulp. The use of the elevated temperature gaseous medium also provides a process requiring only a gaseous short residence time. The non-oxidative nature of the gaseous medium, however, prevents the oxidative degradation of the fibers. This insures that a porous and bulky cellulosic substrate having good color and adequate tensile strength, a tensile strength sufficient to withstand the wind-up tension under normal commercial conditions, can be formed.

Once the pulp has been thermally treated and rendered non-bonding, a substrate such as a 60–70 pound per 3000 square feet paper can be formed from the pulp by any conventional method known to the art, and most particularly, by employing a Fourdrinier-type machine as used in the formation of paper, e.g., as disclosed in U.S. Pat. No. 2,838,982. The pulp is generally slurried with water and then formed into a pulp mat on the screen mesh of the Fourdrinier machine. As the pulp is carried along, the water in the pulp is drained through the wire. The pulp mat then proceeds through the press sections of the machine, and finally, the resulting paper substrate receives the necessary drying in the dryer section of the machine, for example, by contact with heated drums, until a desired degree of dryness for the finished paper is attained.

In a further embodiment of the present invention, a novel and heretofore unknown cellulosic pulp is provided upon thermally treating a wood cellulose pulp, a pulp containing at least about 10% hemicellulose, in accordance with the instant process. Also provided is the novel cellulosic substrate, i.e., paper, formed therefrom. The product obtained when a wood cellulose pulp is treated in accordance with the present invention is that of a nonbonding pulp containing at least about 10% by weight hemicellulose, i.e., the minimal amount of hemicellulose generally found in wood cellulose, characterized in that it forms a cellulosic substrate, e.g., a 60–70 pound per 3000 square foot paper, possessing a void fraction of at least 0.85, a porosity of at least 30 cubic feet of air per minute per square foot at 0.5 inch water pressure drop, and sufficient tensile strength to withstand commercial wind-up operations, i.e., at least about 6 lbs. per inch.

By void fraction is meant the value [1 − volume occupied by mass]. The void fraction of a substrate can be calculated by the following:

$$\text{Volume Occupied by Mass} = \frac{\text{Fiber Mass}}{\text{Paper Vol.}} \times \frac{1}{\text{Fiber Density}}$$

$$\frac{\text{Fiber Mass}}{\text{Fiber Vol.}} = \frac{\text{Basic Weight}}{\text{Caliper}} = \frac{\text{Pounds} \times 12}{3000\ \text{ft}^2 \times \text{Caliper, inches}}$$

Assuming that the fiber density is 1.4 gm/cm$^3$ and converting to cgs standard units gives one the following formula:

$$\text{Void Fraction} = 1 - 0.0000458\ (\text{Basic Weight})/\text{Caliper}$$

from which the void fraction of any substrate can be easily calculated.

The porosity of the substrate is defined as the cubic feet of air per minute passing through one square foot of sheet area with a pressure drop of one half inch of water. The porosity is also known as the air permeability of a substrate and for purposes of the instant invention, is measured in accordance with TAPPI T251 pm-75.

The tensile strength is measured in terms of lbs./inch in accordance with ASTM D828-60.

Normally, a high bulk, highly porous paper possessing a void fraction of at least 0.85 and a porosity of air permeability of at least 30 cubic feet per minute per square foot is obtained from a wood cellulose pulp by mercerizing the pulp. Chemical mercerization removes most of the hemicellulose from the cellulosic pulp to produce a pulp comprising primarily alpha cellulose. The resulting alpha pulp thus contains at least, and generally well in excess of, 90% by weight alpha cellulose, and very little, much less than about 10%, and generally less than about 2% by weight, of hemicellulose. It is the non-bonding character of the alpha cellulose, and the absence of the bonding hemicellulose, which affords the pulp its non-bonding character and thus form a high bulk, highly porous cellulosic substrate.

The process of the instant invention, however, does not result in such a loss of hemicellulose as the hemicellulose remains as part of the pulp. Rather, the nonbinding character of the pulp is afforded via the decrease in hygroscopicity upon thermal treatment of the pulp. Once the pulp has been thusly treated, the pulp can form a high bulk, highly porous substrate which is useful as a filtering medium which contains at least about 10% hemicellulose. In fact, void fractions of at least 0.87 can be obtained, as well as porosities as high as 70 or 90 cubic feet per minute per square foot. Higher void fractions and porosities are more easily afforded paper substrates formed from softwood pulps, in contrast to hardwood pulps, which have been treated in accordance with the instant invention.

In order to further illustrate the present invention and the advantages thereof, the following examples are given, it being understood that same are intended only as illustrative and in nowise limitative. All parts and percentages in the examples and the remainder of the specification are by weight unless otherwise specified.

In the following examples, the void fraction, Frazier porosity and tensile strength are as previously defined.

EXAMPLE I

The bulk, as measured by void fraction, porosity and tensile strength of paper substrates formed from untreated pulp and pulp treated in accordance with the present invention were compared.

In runs 1–3, the paper substrates made from a bleached southern kraft hardwood pulp were evaluated. Run No. 1 was a control run wherein the untreated pulp was slurried and made into a paper substrate. In runs 2 and 3, however, the pulp was first treated with 450° F. steam for a predetermined period of time. The treated pulp was then slurried in water and made into a paper sheet.

In runs 4–6, the paper substrates made from a southern kraft pine pulp were evaluated. Run No. 4 was a control run wherein untreated pulp was slurried and made into a paper sheet. Runs 5 and 6 employed pulp which was first thermally treated with superheated steam for a predetermined period of time. The treated pulp was then slurried and made into a paper sheet.

The resulting sheets of runs 1–6 were evaluated with respect to Frazier porosity and tensile strength, with the void fraction of each being calculated. Table I summarizes the results:

TABLE I

| Run No. | Superheated Steam Conditions | Void Fraction | Frazier Porosity cubic feet/min/ft$^2$ | Tensile Strength (lb/inch) |
|---|---|---|---|---|
| 1 | Control | 0.814 | 14.8 | 43.3 |
| 2 | 1 minute in 450° F. steam | 0.813 | 23.0 | 45.0 |
| 3 | 2 minutes in 450° F. steam | 0.870 | 35.8 | 26.2 |
| 4 | Control | 0.835 | 28.5 | 45.1 |
| 5 | 3 minutes in 450° F. steam | 0.873 | 74.1 | 23.9 |
| 6 | 3.5 minutes in 450° steam | 0.873 | 94.7 | 18.6 |

From the data, particularly runs 3, 5 and 6, one can see that a substrate possessing a void fraction of at least 0.85 and a porosity of at least 30 cubic feet/min/ft$^2$ is obtained upon contacting said substrate with superheated steam of a temperature greater than 400° F., namely, 450° F., for a period of time of greater than one minute, and preferably at least 2 minutes.

EXAMPLE 2

The following data in Table II compares the void fraction, porosity, tensile strength and relative cost of paper substrates made from commercial high bulk pulps with that made from the thermally treated pine pulp of run 6 in Example 1. The various pulps were slurried and made into sheets with each being measured for porosity and tensile strength. The void fraction was calculated for each. The alpha cellulose content of each pulp (and corresponding substrate) is also shown, which information was obtained from *Cellulose Chemistry* by Emil Ott and Harold M. Sparlin, Interscience Publishers, N.Y., 1954.

TABLE II

| Pulp | Alpha Cellulose Contents, % | Void Fraction | Frazier Porosity (cubic feet/min./ft$^2$) | Tensile Strength (lb/inch) | Relative Cost |
|---|---|---|---|---|---|
| Chemically Mercerized Pine | 99 | 0.89 | 200 | 0.5 | 1.40 |
| Alpha Pine | 97 | 0.88 | 160 | 0.5 | 1.30 |
| Cotton Linter | 98 | 0.870 | 194 | 1.0 | 1.60 |
| Thermally Treated Pine | 87 | 0.873 | 94.7 | 18.6 | 1.10 |
| Commercial Pine Kraft | 87 | 0.835 | 28.5 | 45.1 | 1.00 |

One can see that the high alpha cellulose content pulp is bulky, i.e., high void fraction, porous and expensive. The thermally treated pulp of the instant invention can provide a filtering grade substrate at a much lower cost.

EXAMPLE III

Substrates made from southern pine kraft pulp were compared with respect to their fiber bonding index (FBI), from data obtained from a span tensile tester by Pulmac. The higher the FBI value, the more bonding, and thus the lower the void fraction and porosity. The following table reveals the reduction in bonding that can be achieved by thermally treating a cellulosic pulp in accordance with the present invention.

TABLE III

| Pulp | Treatment of Pulp | FBI At Zero Beating |
|---|---|---|
| So. Pine Kraft | None | 0.341 |
| So. Pine Kraft | 3.5 min. in 442° F. Steam | 0.315 |

TABLE III-continued

| Pulp | Treatment of Pulp | FBI At Zero Beating |
|---|---|---|
| So. Pine Kraft | 4.5 min. in 450° F. Steam | 0.08 |
| So. Pine (Mercerized) | Commercial Mercerization | 0.243 |

From the data, one can see that the thermal treatment severely reduces the bonding of the cellulose fiber.

While the invention has been described in terms of various preferred embodiments, the skilled artisan will appreciate that various modifications, substitutions, omissions, and changes may be made without departing from the spirit and scope thereof. Accordingly, it is intended that the scope of the present invention be limited solely by the scope of the following claims.

What is claimed is:

1. In a process for forming a porous cellulosic paper from a cellulose pulp, wherein the improvement consists essentially of thermally treating a cellulosic pulp by contacting the cellulosic pulp with a medium consisting essentially of a non-oxidizing gaseous medium at a temperature of at least about 400° F. for a period of time greater than three seconds and sufficient to render the cellulosic pulp essentially non-bonding, and forming a cellulosic paper with said thermally treated non-bonding pulp, said paper possessing (i) a void fraction of at least 0.85, (ii) a porosity of at least 30 cubic feet per minute per square foot and (iii) a tensile strength of at least 6 lbs./in.

2. The process of claim 1, wherein said pulp is contacted with the non-oxidizing gaseous medium for at least one minute.

3. The process of claim 1, wherein said pulp is contacted with the non-oxidizing gaseous medium for at least two minutes.

4. The process of claim 1, wherein the cellulosic pulp is fluffed prior to the thermal treatment.

5. The process of claim 1, wherein the cellulosic pulp comprises wood cellulose.

6. The process of claim 1, wherein said non-oxidizing gaseous medium is employed at a temperature in the range from about 400° to about 1200° F.

7. The process of claim 6, wherein said temperature is in the range from about 450° to about 900° F.

8. The process of claim 1, wherein the contacting of the porous cellulosic subsstrate with the non-oxidizing gaseous medium is for a period of time in the range of from about 2 to about 6 minutes.

9. The process of claim 8, wherein the contacting is for a period of time in the range of from about 3 to about 5 minutes.

10. The process of claim 9, wherein the temperature of the non-oxidizing gaseous medium employed is about 450° F.

11. The process of claim 1, wherein the pressure employed during the contacting step is less than about 5 p.s.i.g.

12. The process of claim 11, wherein said pressure is in the range from about −5 to about +5 p.s.i.g.

13. The process of claim 1, wherein the non-oxidizing gaseous medium comprises superheated steam.

14. The process of claim 1, wherein the non-oxidizing gaseous medium comprises carbon dioxide.

15. The process of claim 14, wherein the carbon dioxide comprising non-oxidizing gaseous medium is the stack gas obtained from the combustion of natural gas and air.

16. The process of claim 1, wherein the non-oxidizing gaseous medium comprises a flue or stack gas.

17. The process of claim 1, wherein the cellulosic pulp is obtained from a formed cellulosic substrate.

18. The process of claim 17, wherein the formed cellulosic substrate is a cellulosic paper.

19. The process of claim 17, wherein the pulp is contacted with the non-oxidizing gaseous medium for at least one minute.

20. The process of claim 17, wherein the pulp is contacted with the non-oxidizing gaseous medium for at least two minutes.

21. The process of claim 17, wherein said non-oxidizing gaseous medium is employed at a temperature in the range of from about 400° to about 1200° F.

22. The process of claim 21, wherein said temperature is in the range from about 450° to about 900° F.

23. The process of claim 17, wherein the contacting of the porous cellulosic substrate with the non-oxidizing gaseous medium is for a period of time in the range of from about 2 to about 6 minutes.

24. The process of claim 23, wherein the contacting is for a period of time in the range of from about 3 to about 5 minutes.

25. The process of claim 24, wherein the temperature of the non-oxidizing gaseous medium employed is about 450° F.

26. The process of claim 17, wherein the pressure employed during the contacting step is less than about 5 p.s.i.g.

27. The process of claim 26, wherein said pressure is in the range of from about −5 to about +5 p.s.i.g.

28. The process of claim 17, wherein the non-oxidizing gaseous medium comprises superheated steam.

29. The process of claim 17, wherein the non-oxidizing gaseous medium comprises carbon dioxide.

30. The process of claim 29, wherein the carbon dioxide comprising non-oxidizing gaseous medium is the stack gas obtained from the combustion of natural gas and air.

31. The process of claim 17, wherein the non-oxidizing gaseous medium comprises a flue or stack gas.

32. The process of claim 17, wherein the rendered cellulosic pulp obtained from the paper comprises a wood cellulose containing at least about 10% hemicellulose.

* * * * *